United States Patent [19]

Tatavoosian et al.

[11] Patent Number: 4,967,329

[45] Date of Patent: Oct. 30, 1990

[54] LENS MOUNTING AND SEAL FOR ILLUMINATED APPARATUS

[75] Inventors: Vanacan Tatavoosian, Mission Viejo; George E. Schaeffer, El Toro, both of Calif.

[73] Assignee: Eaton Corporation, Cleveland, Ohio

[21] Appl. No.: 497,372

[22] Filed: Mar. 22, 1990

[51] Int. Cl.[5] ..... F21V 29/00

[52] U.S. Cl. ..... 362/267; 362/240; 362/293; 362/369; 362/390

[58] Field of Search ..... 362/240, 267, 268, 293, 362/369, 390, 310

[56] References Cited

U.S. PATENT DOCUMENTS 2,686,868 8/1954 Diedring ..... 362/267
2,786,129 3/1957 Mears ..... 362/267
4,523,263 6/1985 Poyer ..... 362/267

*Primary Examiner*—Carroll B. Dority
*Attorney, Agent, or Firm*—L. G. Vande Zande

[57] ABSTRACT

An annunciator panel for aircraft has a plurality of pockets defining individual illuminated indicator devices. A lens assembly comprising a plastic lens and glass filters bonded together is encompassed by an elastically stretched rubber sleeve having an integral flange compressed between the lens body and panel housing, providing a light, fluid and particulate seal between lens and housing as well as a vibration and shock buffer to the lens and filters. The resiliency of the rubber sleeve accommodates different thermal expansion between dissimilar materials without imparting damage stresses to the lens assembly.

23 Claims, 1 Drawing Sheet

LENS MOUNTING AND SEAL FOR ILLUMINATED APPARATUS

CROSS REFERENCE TO RELATED APPLICATION

This application is related to copending application Ser. No. 497,454 filed concurrently herewith in the name of Vanacan Tatavoosian entitled Omnidirectional Shock Absorbing Lamp Mounting System for Illuminated Apparatus and assigned to the assignee of this application.

BACKGROUND OF THE INVENTION

This invention relates to illuminated apparatus, particularly to a means of mounting a lens assembly therein which provides improved thermal endurance for the lens assembly as well as minimizing adverse affects of shock and vibration thereon. More particularly, this invention relates to illuminated indicator devices of the aforementioned type which are to be compatible with night vision goggle (NVG) technology and to seals which prevent the egress of light and the ingress of contaminants around the lens assembly.

Illuminated indicators are generally mounted on or contained in a panel to provide a signal by their illumination of some remote function. In certain devices the mere illumination provides the signal; in other devices a captioned lens is illuminated to provide information or instruction in addition to the illumination signal. Light leakage around a lens or from other cracks or joints of the indicator device is undesirable in many applications and is a particular problem when such indicators are to be compatible with NVG technology as in the cockpit of an aircraft. NV goggles greatly intensify light to allow the wearer to see clearly at night. The illuminated indicator devices found on an aircraft annunciator panel have lens assemblies which include filters to specifically filter out (block) certain wavelengths of the illuminated indicator light source such as the infrared and near infrared wavelengths, and to pass only the visible wavelengths. Light containing the unfiltered wavelengths leaking or escaping around the lens can produce a glare for the wearer of the night vision goggles and can also be detected by systems particularly sensitive to infrared wavelengths. This problem is magnified in illuminated indicator devices used in aircraft because high intensity light sources are used to enable the devices to be readable in bright sunlight.

Another problem particularly prevalent in aircraft cockpits is wide temperature variations, influenced primarily by the presence or absence of the sun, but also by localized affects of plural high intensity lamps contained within the device or panel.

SUMMARY OF THE INVENTION

This invention provides an illuminated indicator device having a lens assembly seal which prevents the leakage of light around the lens assembly and a means of mounting the lens assembly to accommodate dimensional variations, shock and vibration. The invention comprises an opaque elastomer disposed in intimate contact with the periphery of a filtering means adjacent a rear surface of the lens and an integral outwardly projecting flange that is compressed against a housing to effect the desired seal and resilient mounting. The elastomer comprises a rubber sleeve which is stretched over the edges of the filtering means and a rear projection of the lens to provide a tight seal therebetween, the elasticity of the rubber sleeve being tolerant of different thermal expansion characteristics of the filtering means and the lens. The integral flange comprises a bead adjacent a rear surface of the lens and projecting beyond the periphery of the lens to space the lens from an interior surface of the housing, thereby to cushion the lens and filtering means from shock and vibration imparted to the housing. The flange biases a front face of the lens assembly against a rim defining an opening in the housing and centers the lens assembly within the opening for cushioned, rattle-free, centered mounting of the lens within the housing and permits the lens to be replaced without the use of adhesives or special tools. The seal further prevents the ingress of contaminants around the lens assembly into the housing.

The foregoing and other features and advantages of the lens mounting and seal for an illuminated indicator device of this invention will become readily apparent and understood when reading the following description and appended claims in conjunction with the accompanying drawings.

DETAILED DESCRIPTION OF THE PREFERRED EMBODIMENT

Figure 1:
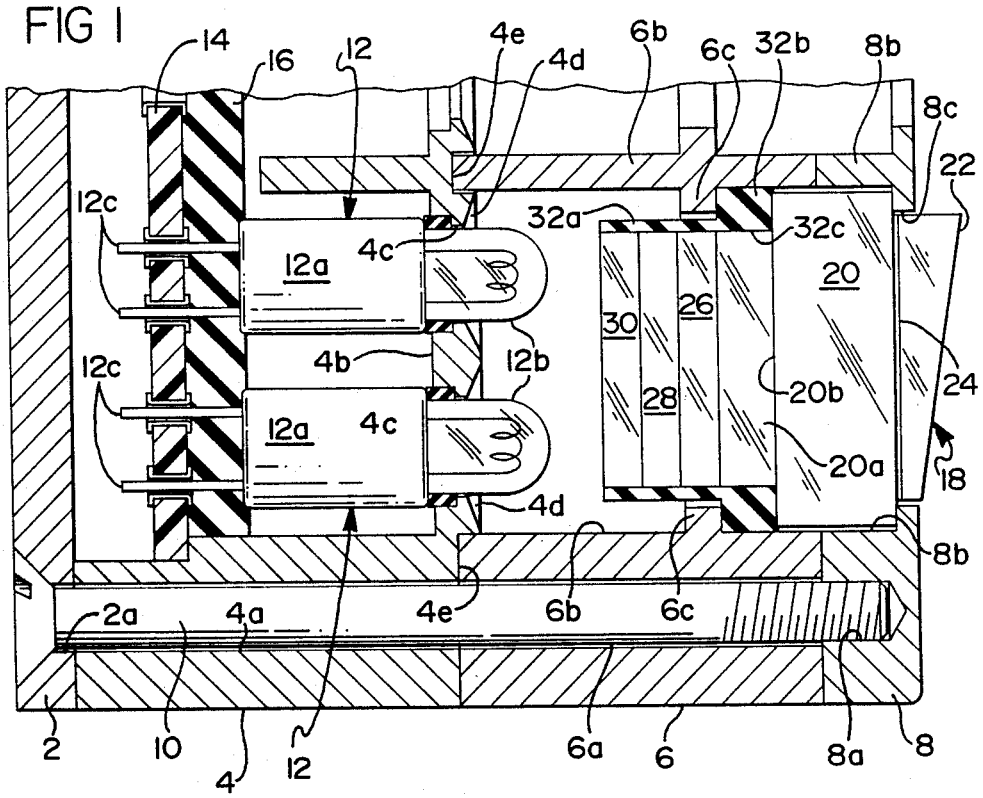
FIG. 1 is a cross sectional view of an illuminated indicator device having a lens assembly and lens mounting and seal member in accordance with this invention.

An illuminated indicator device according to this invention may be an individual device or, as shown in the drawings, may be one pocket of a multi-pocket indicator panel, referred to in the aircraft industry as an annunciator panel. The panel comprises a rear cover 2, a base 4, a lens mounting section 6 and a bezel 8 all secured together in stacked relation to form a housing for the device by a plurality of screws 10 (only one shown) which pass through countersunk clearance holes **2*a* in back cover 2 and aligned clearance holes 4*a* and 6*a* in base 4 and lens mounting section 6 to engage blind threaded holes 8*a* in the back surface of bezel 8**.

Base 4 has a front wall **4*b* continuous to all pockets in the panel. A plurality of openings 4*c* are provided in front wall 4*b*, one or more openings 4*c* being provided for each pocket. The front surface of wall 4*b* has reflector surfaces 4*d* formed generally concentric with the respective holes 4*c* for reflecting light forward in the device. Surfaces 4*d* may be beveled, frusto-conical, faceted, curved parabolic or the like as desired. Moreover, the front surface of front wall 4*b* may be plated with a bright material providing a highly reflective surface. A lamp 12 is provided for each opening 4*c*, the individual lamp having a cylindrical main body 12*a* and a reduced diameter tubular glass envelope 12*b* extending from one end of body 12*a* through the respective opening 4*c*. Lamps 12 are trapped between wall 4*b* and a rigid member, e.g. a printed circuit board 14 providing electrical connection with leads 12*c* of the respective lamps. A rubber cushion 16 is disposed against the forward surface of printed circuit board 14 to resiliently bear directly against the rear ends of lamps 12**.

Wall 4b of base 4 and lens mounting section 6 are divided into a pattern of aligned pockets by forwardly extending walls 6b in section 6 which nest within corresponding grooves 4e in the front face of wall 4b. A flange 6c is formed on the walls 6b around the entire interior periphery of each pocket of lens mounting section 6. Bezel 8 is provided with a plurality of rearwardly extending walls 8b which coincide with the walls 6b to complete the plurality of pockets, each defining an illuminated indicator device. The front face of bezel 8 is provided with openings 8c which are substantially centered within the respective pocket defined by the walls 8b.

Figure 2:
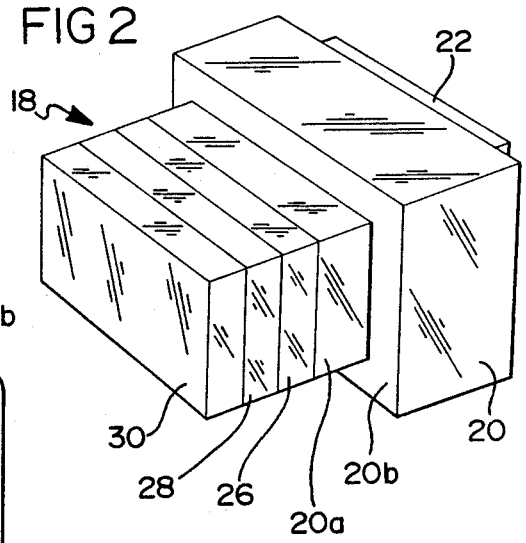
FIG. 2 is a perspective view of the lens assembly for the illuminated indicator device of FIG. 1.

A lens assembly 18 is shown apart from the indicator device in FIG. 2. Lens assembly 18 comprises a substantially rectangular transparent lens member 20 having a stepped-down rear rectangular projection 20a. A reduced size trapezoidally shaped member 22 is bonded to a front face of lens 20. Indicia bearing the caption for the illuminated indicator device is preferably disposed at this bonded junction between member 22 and lens 20. The indicia may be embodied in a coating or film applied to either surface or in a thin strip 24 bonded between the lens 20 and member 22. One or more rectangular filters 26, 28 and 30 are bonded together face-to-face and to the rear surface of projection 20a of lens 20 in a stacked relation. The peripheral configuration of the glass filters is coincident with the peripheral configuration of projection 20a. It is preferable in this exemplary embodiment to make lens 20 of a transparent plastic material which may be tinted to a desired color. Projection 20a is integral with lens 20, although it could be a separate piece bonded to the lens as is member 22, also made of plastic. The bonding is accomplished by ultrasonic welding or the like, but could be done by adhesives. Filters 26, 28 and 30 are preferably made of glass and are bonded together and to lens 20 by a suitable adhesive.

Figure 3:
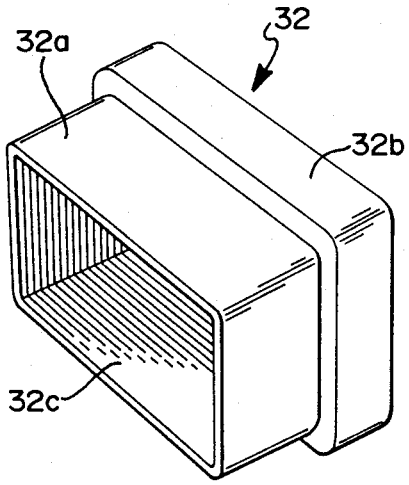
FIG. 3 is a perspective view of the mounting and seal member for the illuminated indicator device of FIG. 1.

The seal 32 of this invention is shown in perspective view in FIG. 3, aligned for positioning to the lens assembly 18. Seal 32 is an opaque elastomer sleeve such as a silicon rubber or the like having good elastic qualities. It comprises a sleeve portion 32a of substantially uniform thin wall thickness and an integral outwardly projecting peripheral flange 32b at the forward end thereof. A rectangular opening 32c extends completely through seal 32. In cross section flange 32b comprises a rectangular mass which is significantly thicker than the wall thickness of sleeve portion 32a. The seal 32 is stretched over the rear projection 20a of lens 20 and the bonded filters 26, 28 and 30 such that a forward surface of flange 32b seats squarely against the rim 20b formed at the back surface of lens 20 around the rear projection 20a. When positioned to the lens assembly 18 as described above, the flange 32b projects transversely beyond the edge surfaces of lens 20. The sleeve 32a extends rearwardly surrounding the peripheral edges of the filters 26, 28 and 30. In positioning the sleeve 32 on the rear projection and filters, it is necessary to elastically stretch the sleeve 32. The size of the sleeve is such that it is still somewhat elastically stretched when it is in position on the lens and filter assembly 18 so that it seals tightly against all of the edge surfaces of the filters and lens comprising the respective peripheries thereof.

The lens assembly 18 with seal 32 affixed thereon is positioned in lens mounting section 6 such that a rear surface of flange 32b rests squarely against peripheral flange 6c within housing 6. The exterior dimensions of flange 32b closely conform to the interior dimensions of the pocket in lens mounting section 6 to position the lens assembly transversely within the housing. Conversely, the exterior dimensions of sleeve 32a are significantly less than the dimensions defining the opening through flange 6c, providing significant clearance between the housing and the sleeve 32a. Bezel 8 is positioned to the forward end of section 6 such that the walls 8b are aligned with corresponding walls 6b of section 6. When so positioned, forward openings 8c align with and are disposed over forward projections 22 of the respective lens 20. Opening 8c is smaller than the pocket 8b, thereby defining an overhanging lip around the opening 8c, the lip engaging the forward edge of lens 20 adjacent the forward projection 22. As the housing assembly is secured together and bezel 8 clamped firmly against 6 by screws 10, flange 32b is compressed front-to-rear between the rim 20b of lens 20 and the forward surface of flange 6c to establish a good compressive seal between these respective surfaces. The outer edge wall of flange 32b is bulged outward by such compression firmly against the interior surface of wall 6b to establish a seal between these surfaces.

Seal 32 centrally aligns lens assembly 18 within the pocket of the housing, maintaining peripheral edges of lens 20 spaced from walls 6b and 8b and of member 22 spaced from the edges of opening 8c. Compression of flange 32b between lens rim 20b and flange 6c exerts a forward bias on lens 20, pressing it firmly against the rim of bezel 8 in rattle-free engagement therewith. Resiliency provided by sleeve 32a accommodates variations in thermal expansion between lens 20 and glass filters 26, 28 and 30 without creating destructive stresses within the elements. The full resilient support of lens assembly 18 by the rubber flange 32b , with the sole exception of lens 20 pressing against the bezel rim, minimizes transmission of vibration and shock from the housing to the lens assembly 18, reducing the potential for damage to the lens from these factors. Moreover, seal 32 provides an effective fluid tight and dust tight seal, protecting the interior of the indicator device from the ingress of contaminants from the forward bezel side of the assembly. Finally, seal 32 prevents light from lamps 12 from leaking around lens assembly 18 and exiting opening 8c. Filters 26, 28 and 30 are specially fabricated to block certain predetermined wavelengths in the infrared class, and all light exiting through lens 20 and opening 8c must pass through the filters.

Although the lens mounting and seal for an illuminated indicator device of this invention has been described herein according to a preferred embodiment, it is to be understood that the invention is susceptible of various modifications without departing from the scope of the appended claims.

What is claimed:

1. Illuminated apparatus comprising:

a housing having a front opening;

a light source within said housing;

a lens mounted in said front opening;

filter means disposed between said lens and said light source within said housing, said filter means passing only predetermined wavelengths from said light source to said lens;

sealing means comprising an opaque elastomer disposed around a peripheral edge of said filter means in intimate contact therewith, said elastomer having an outwardly extending peripheral flange; and means compressing said flange against said housing along an entire interior periphery thereof preventing light passage between said sealing means and said housing.

2. The illuminated apparatus as defined in claim 1 wherein said housing comprises a flange along said interior periphery, said sealing means flange being compressed against said housing flange.

3. The illuminated apparatus as defined in claim 1 wherein said housing comprises a removable front bezel in which said front opening is disposed, said opening defining a rim overlying a portion of said lens, said housing comprising a forward facing surface along said interior periphery, said sealing means flange being compressed between said forward facing surface and said lens upon attachment of said bezel to said housing.

4. The illuminated apparatus as defined in claim 3 wherein said filter means comprises at least one glass plate disposed adjacent a rear surface of said lens.

5. The illuminated apparatus as defined in claim 4 wherein said opaque elastomer sealing means comprises an elastic sleeve.

6. The illuminated apparatus as defined in claim 5 wherein said sleeve is elastically stretched around said peripheral edge of said filter means in intimate contact with said edge.

7. The illuminated apparatus as defined in claim 6 wherein said lens comprises a stepped down projection at said rear surface, a peripheral edge of said projection being substantially coincident with said peripheral edge of said filter means, and said sleeve extending over said projection in intimate contact with said peripheral edge of said projection.

8. The illuminated apparatus as defined in claim 7 wherein said sealing means flange comprises an integral bead at a forward end of said sleeve, said bead comprising a significantly increased mass relative to said sleeve.

9. The illuminated apparatus as defined in claim 8 wherein said bead provides generally planar front and rear surfaces.

10. The illuminated apparatus as defined in claim 9 wherein a peripheral edge of said bead between said planar front and rear surfaces thereof extends outward beyond a corresponding peripheral edge of said lens, said bead providing a resilient cushion spacing said lens from said interior periphery of said housing.

11. The illuminated apparatus as defined in claim 10 wherein said lens comprises a stepped down projection at a front surface of said lens, said front projection extending through said front opening in said bezel, and said spacing of said lens from said interior periphery of said housing by said resilient cushion provided by said bead also spaces said front projection away from an interior edge of said opening.

12. The illuminated apparatus as defined in claim 11 wherein said rear projection defines a rearward facing rim on said lens, said planar front surface of said bead being disposed adjacent said rearward facing rim, and compression of said bead upon attachment of said bezel to said housing bulging said peripheral edge of said bead against said interior periphery of said housing.

13. The illuminated apparatus as defined in claim 12 wherein said filter means is bonded to said rear surface of said lens.

14. The illuminated apparatus as defined in claim 13 wherein said filter means compresses a plurality of glass plates bonded together face-to-face in stacked relation.

15. The illuminated apparatus as defined in claim 14 wherein compression of said bead to said housing comprises a contaminent seals, preventing contaminants from entering a light source area of said housing from through said lens opening in said bezel.

16. The illuminated apparatus as defined in claim 11 wherein said front projection comprises a separate element bonded to said lens, indicia being provided at a bonding juncture of said lens and said front projection.

17. Illuminated apparatus comprising:

a housing having a compartment therein open to a front of said housing;

a light source in said compartment;

a lens disposed in said compartment proximate said front of said housing, said lens comprising a stepped-down portion facing into said compartment;

an elastomer member stretched around said stepped-down portion extending laterally beyond said lens, spacing said lens from interior walls of said compartment, said elastomer member abutting a shoulder in said compartment; and a cover attached to said front of said housing over said lens, said cover pressing said lens inward when attached to said housing, compressing said elastomer member between said shoulder and said lens, resiliently mounting said lens to said housing.

18. The illuminated apparatus defined in claim 17 wherein said cover comprises an opening disposed over a forward face of said lens, said cover abutting a front surface of said lens along a rim of said opening.

19. The illuminated apparatus defined in claim 18 wherein said cover abutting said lens constitutes an only direct engagement of said housing with said lens.

20. The illuminated apparatus defined in claim 18 wherein said elastomer member expands laterally into engagement with interior sides of said compartment when compressed between said shoulder and said lens, effecting a seal between said housing and said lens.

21. The illuminated apparatus defined in claim 18 wherein said lens comprises at least one filter bonded to said stepped-down portion and said elastomer member comprises an integral sleeve having substantially reduced wall thickness stretched around said filter.

22. The illuminated apparatus defined in claim 21 wherein said housing, said lens and said filter comprise dissimilar materials each having different coefficients of thermal expansion accommodated by said elastomer member without stressing said lens or said filter.

23. The illuminated apparatus defined in claim 21 wherein said elastomer member is opaque, said member preventing light from said light source from passing through said opening in said cover without passing through said filter.

* * * * *